US005213554A

United States Patent [19]

Goldstein et al.

[11] Patent Number: 5,213,554

[45] Date of Patent: May 25, 1993

[54] STEPPING DEVICE

[75] Inventors: Eric Goldstein, Roswell; William J. Saunders, Lithonia; Edward Leftwich, Decatur, all of Ga.

[73] Assignee: The Step Company, Atlanta, Ga.

[21] Appl. No.: 724,205

[22] Filed: Jul. 1, 1991

[51] Int. Cl.[5] ..... A47B 85/00; A47B 91/02; A63B 22/00

[52] U.S. Cl. ..... 482/52; 482/909; 108/19; 248/188.2

[58] Field of Search ..... 482/51, 52, 909; 403/3; 108/11, 12, 19, 156, 157, 159; 248/188, 188.2, 911; 297/438, 439; 211/207, 208

[56] References Cited

U.S. PATENT DOCUMENTS

| | | | |
|---|---|---|---|
| 2,750,709 | 6/1956 | Saverino | 248/188.2 X |
| 3,865,050 | 2/1975 | Cecchetti | 108/156 X |
| 5,037,084 | 8/1991 | Flor | 482/52 |
| 5,050,861 | 9/1991 | Thomas et al. | 482/52 |
| 5,096,186 | 3/1992 | Wilkinson et al. | 108/12 X |

FOREIGN PATENT DOCUMENTS

| | | | |
|---|---|---|---|
| 1079004 | 8/1967 | United Kingdom | 297/439 |
| 0004904 | 7/1988 | World Int. Prop. O. | 297/439 |

*Primary Examiner*—Robert P. Swiatek
*Assistant Examiner*—L. Thomas
*Attorney, Agent, or Firm*—Needle & Rosenberg

[57] ABSTRACT

A device for aerobic step exercises comprising a platform with a flat top, the underside of the platform having a cavity into which either the first or second end of a support member is inserted. Each end has an opening therein or a slot therethrough of a certain depth which contacts engaging means within the cavity to maintain the top of the platform at a certain pre-selected height above the support surface. A respective numeral corresponding to the height is disposed on the support member adjacent its first and second ends. The numeral can be viewed through an opening in the platform when the support member is inserted into the cavity.

15 Claims, 3 Drawing Sheets

STEPPING DEVICE

BACKGROUND OF THE INVENTION

The present invention relates to aerobic exercise devices and, more particularly, to a height adjustable aerobic step exercising device.

It is known in aerobic exercising to use a conditioning program based on stair climbing to develop, simultaneously, strength and improved cardiovascular endurance. For instance, during a 60-minute aerobic workout, the participant may, using optional hand-held weights, climb on and off platforms that are available at a number of different heights. Such stepping sessions may last from five to twenty-five minutes per period during such workouts and are combined with traditional aerobic movements.

A disadvantage of the present stair climbing programs is that they utilize fixed-height platforms which do not easily accommodate participants of varying degrees of physical height or expertise in aerobics. Also, the fixed platforms or steps make it more difficult to vary the intensity of the exercise. In group classes, the participant may be forced to use a step at a particular height based only upon availability and not upon proper sizing. This can make a workout either too hard or too easy. Also, in the home market, the fixed-height platform does not allow for interval training or improved conditioning of the participant.

SUMMARY OF THE INVENTION

The above disadvantages are overcome by the present invention which comprises a rectangular platform having a flat top, and depending, opposed side and end walls and a rectangular cavity adjacent to each end wall. A pair of support members is provided, each member having opposed first and second ends and each being dimensioned to be received within the cavities. Each end of the support members has a respective first or second opening of a first or second depth which contact an engaging means in each of the cavities. Thus, depending upon which end of the support member is inserted into the cavity, the top is maintained at a certain pre-selected height above the support surface.

First and second numerals are respectively disposed on the support members adjacent the first and second ends, each numeral corresponding to the height at which the platform is maintained above the support surface when that respective end is inserted into a cavity. An opening is provided through each side wall in registry with the numerals so that the user can view the numeral and know at what height the top is.

DETAILED DESCRIPTION OF THE ILLUSTRATIVE EMBODIMENT

Figure 1:
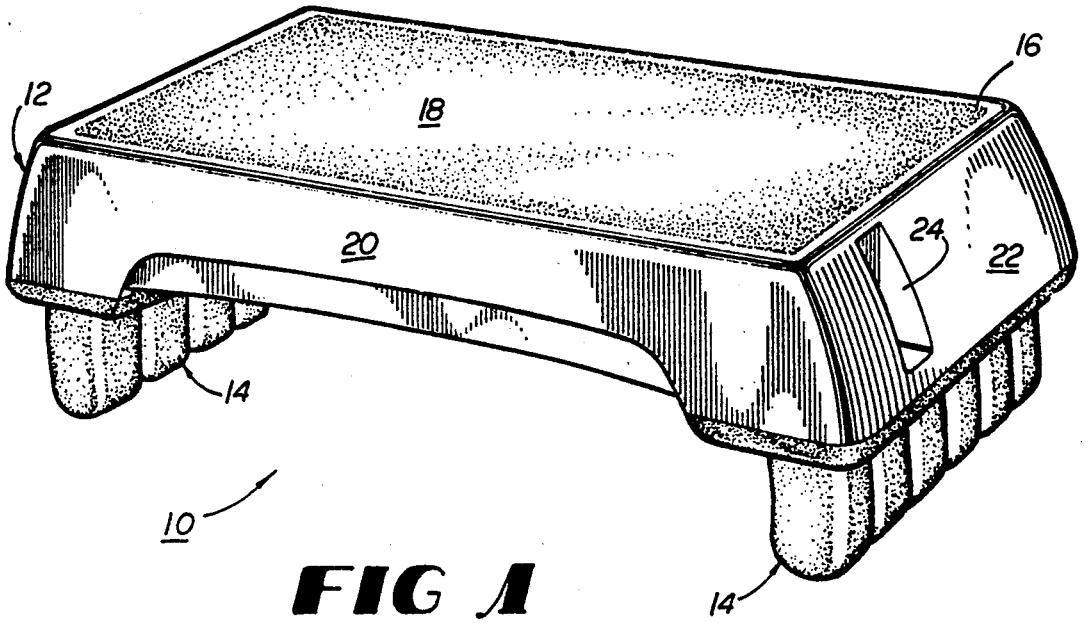
FIG. 1 is a top perspective view of the present invention.
Figure 2:
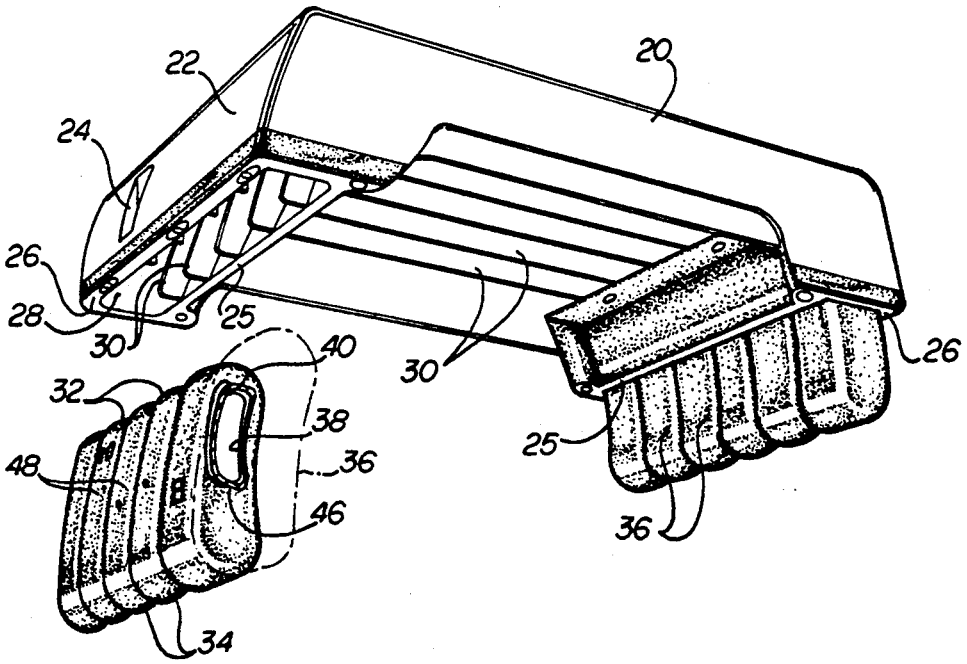
FIG. 2 is a bottom perspective view of the device with one of the support members exploded away for clarity.
Figure 3:
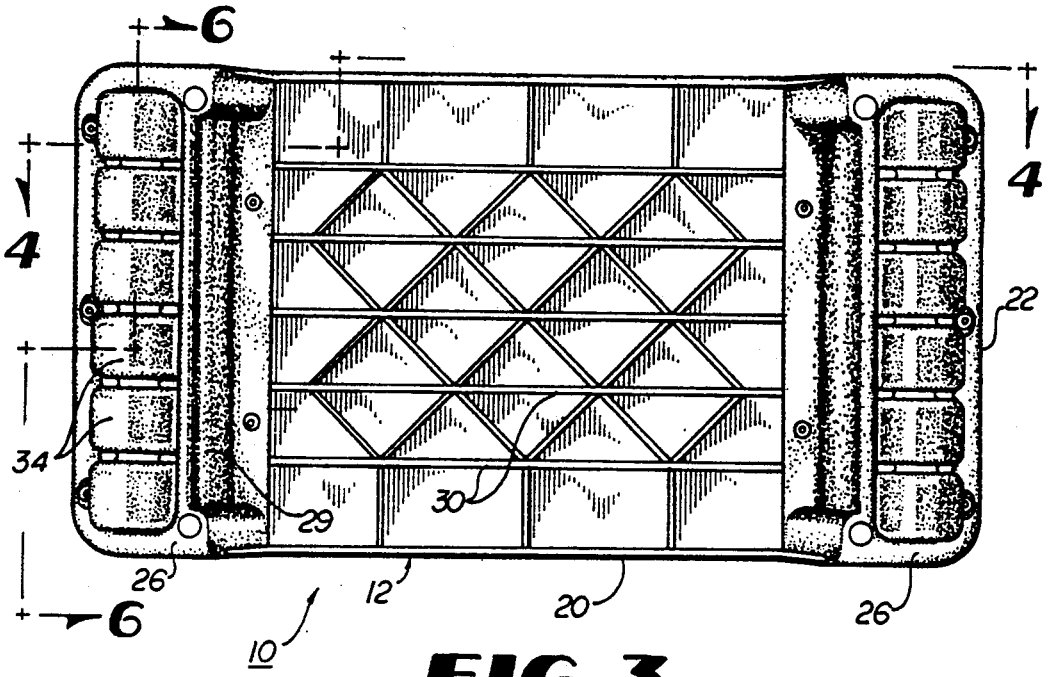
FIG. 3 is a bottom plan view of the present invention.

Referring to the figures of the drawings, the numeral 10 denotes generally the stepping device of the present invention. The stepping device 10 comprises a platform 12 and a pair of equally dimensioned support members 14 for elevating the platform 12 a pre-determined height or distance above a support surface. The platform 12 and support members 14 may be constructed out of any suitable lightweight material, such as plastic. The platform 12 is generally rectangular in shape and has a flat top stepping surface 16 preferably with a non-skid surface 18. The platform 12 also includes downwardly depending, opposed side walls 20 and opposed end walls 22. An elongated, vertical opening 24 is provided through each end wall 22 in diametrically opposed relationship. As seen more clearly in FIGS. 4 and 5, the end walls 22 taper gently outward from the stepping surface 16 and terminate in a flat bottom surface 26. The flat bottom surface 26 is provided for stability when the platform rests on a support surface. A rectangular cavity 28 is formed in the underside of the platform 12 adjacent each end wall 22 between laterally extending ribs 25, which extend between side walls 20. Each cavity 28 is dimensioned to receive therein one end of a support member 14, as described below. Extending into the cavity 28 are a plurality of engaging means or separators 30 which longitudinally extend beneath the top stepping surface 16 and extend outward from laterally extending ribs 25 and opposed end walls 22 in spaced, parallel relationship (FIGS. 2 and 3).

Figure 6:
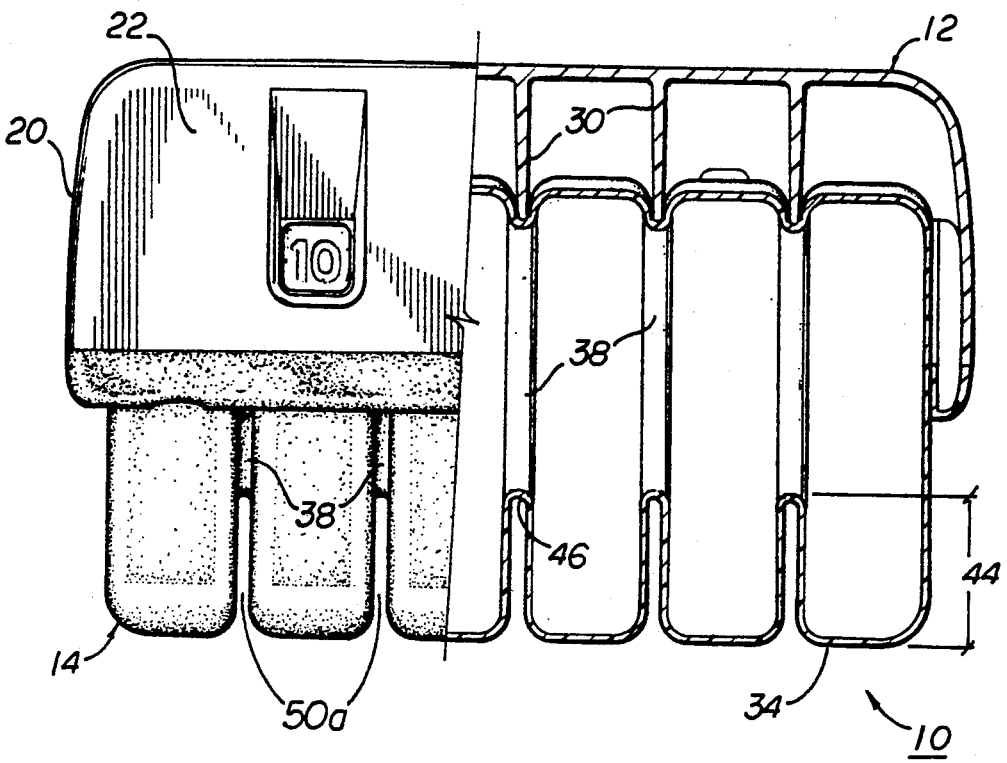
FIG. 6 is a left end view of the device taken along lines 6—6 in FIG. 3 with a portion broken away for clarity.
Figure 7:
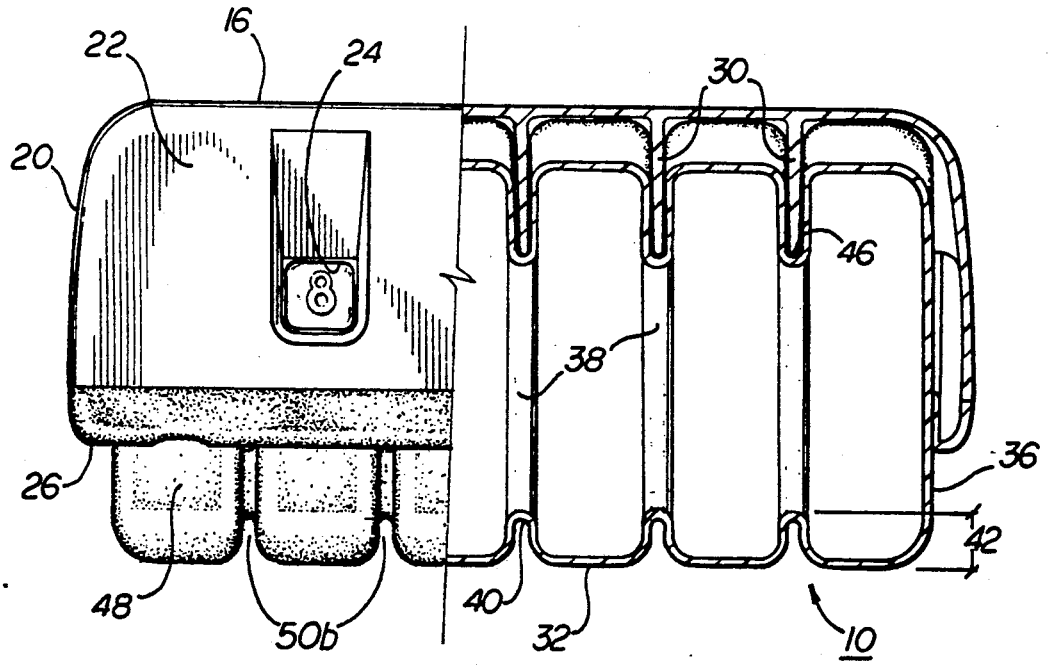
FIG. 7 is a left end view of the device taken along lines 7—7 in FIG. 5 with a portion broken away for clarity.

The support members 14 are equally dimensioned, having a rectangular shape and an arcuate profile and have a first end 32 and an opposed second end 34. Either first end 32 or second 34 contacts the supporting surface depending on which end of the support members 14 are inserted into the cavity 28. The support members 14 are comprised of a number of equal dimensioned units 36, each of which has essentially an arcuate configuration. As shown, each support element 14 consists of six of the units 36 which are preferably hollow and are integrally joined together at junctures 38 which form an opening or slot **50*a*, 50 *b* between adjacent units 36 sufficient to receive therein the separators 30, as seen in FIG. 6 and 7. The distance from the first end 40 of the junctures 38 to the first end 32 of the support member 14 defines a first depth or distance 42 which is less than the second depth or distance 44 measured from the second end 46 of the junctures 38 to the second end 34 of the support member 14. The parallel slots between the first ends 32 of adjacent units 36 are disposed in vertical alignment with the slots disposed between the second ends 34. Preferably first end 40 and second end 46 of the juncture 38 are flat in shape such that when the support members are inserted into the cavity 28, the stepping device 10** rests on the supporting surface, such as the floor or ground, in a stable condition.

The units 36 have an outer face 48 on which is disposed a numeral indicating the height of the stepping surface 16 relative to the supporting surface. As seen in FIGS. 2, 6 and 7, the numerals, labelled as "8" and "10", are in diametrically opposed positions relative to each other, with the numeral "8" disposed at or near the second end 34 and the numeral "10" located at or near the first end 32. The numerals "8" and "10" represent 8 inches and 10 inches, respectively, and are positioned on outer face 48 so that when the second end 34 is received within the cavity 28, the numeral "8" is in registry with opening 24 and can be viewed therethrough, as seen in FIG. 7. Likewise, when first end 32 is received within the cavity 28, the numeral "10" appears through opening 24 as seen in FIG. 6. The numerals indicate a height at which the top stepping surface 16 is being maintained above a support surface by the support member.

In operation, the device 10 can be first utilized by placing the platform 12 (which is preferably 6 inches in height) on a flat support surface without any support member 14 being within the cavities 28. Aerobic step exercises can then be performed at that height until the heartbeat of the user reaches a first level. Then, second ends 34 can be quickly inserted into each cavity 28 so that the stepping surface 16 is maintained at 8 inches above the support surface. When the heart rate is elevated to a second level, the user can withdraw each support member 14, turn them and insert the first ends 32 into the cavities 28 so that the height of the stepping surface 16 is now 10 inches above the support surface. Of course, the user can just insert either desired end of the support member 14 to begin the exercises and maintain that selected height throughout the program.

Figure 4:
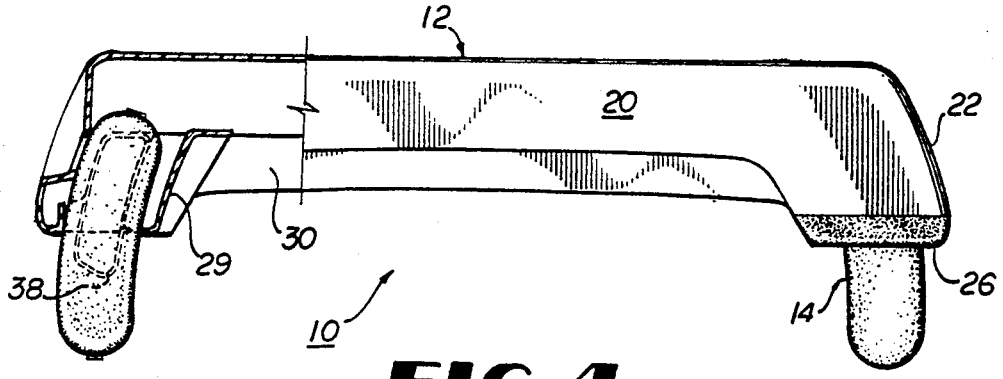
FIG. 4 is a side view taken along lines 4—4 in FIG. 3 with one end of the support member shown in its operative position.
Figure 5:
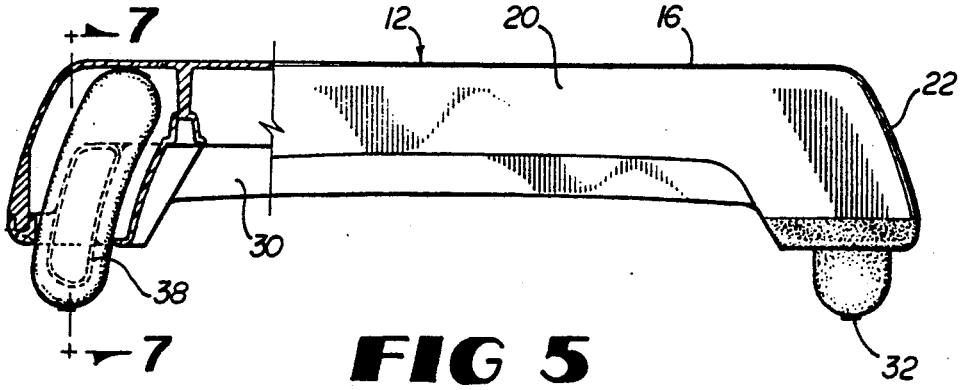
FIG. 5 is a side view of the device with the other end of the support member shown in its operative position.

As seen in FIGS. 4 and 5, the arcuate shape of the support members 14, the contoured dimensions of the cavities 28, and the flat surfaces of the first end 40 and second end 46 of the junctures 38 create a stable platform 12, regardless of which end of the support members 14 is used. Further, the shape of the support members 14 and the cavities 28 ensure that the members 14 are placed into the respective cavities only in a certain orientation. The cavities 28 are located at the opposed end walls 22 in the disclosed embodiment, but they may be conveniently located in any desired position on the platform 12 as long as the platform 12 is maintained in a stable position with the support members 14 in their operative positions or removed form the cavities 28. Additionally, while the dimensions of a typical stepping device 10 include a platform 12 having a height of 6 inches, and stepped heights of 8 or 10 inches depending on which ends 32 or 34 are inserted into cavities 28, other heights or distances can be selected.

Also, while slots in the ends 32 and 34 are shown to receive the separators 30, alternative designs could include openings into the ends 32 and 34 which would engage protrusions that extend downwardly from the bottom of the platform 12 into the cavities 28.

Another embodiment of the present invention is to provide only one centrally located cavity with one support member insertable therein. Again, the criteria for the design of this embodiment, as for the above-described other embodiments is that, in operation, the platform will not tip over, wobble or otherwise seem unbalanced to the user.

What we claim is:

1. A device for aerobic exercising, comprising:

(a) a platform having a flat top;

(b) a pair of cavities formed in the underside of the platform;

(c) a pair of equally dimensioned support members that each have opposed first and second ends which are dimensioned to be received within the cavities, the first and second ends defining a first and second opening therein, respectively, with the openings being in vertical alignment with each other and having a first and second depth, respectively; and (d) means in each cavity for engaging the openings when each of said selected first or second end of the support members is inserted into a cavity, so tat the platform is maintained at certain selected heights above a support surface depending upon which of the first and second ends are within the cavities.

2. The device of claim 1 wherein the support members are substantially rectangular in shape.

3. The device of claim 1 wherein the profile of each of the support members is arcuate in shape.

4. The device of claim 1 wherein the openings are slots in the respective ends.

5. The device of claim 4, wherein a plurality of first slots are disposed in spaced apart, parallel relationship along the first end of the support member and wherein a plurality of second slots are disposed along the second end in vertical alignment with the first slots.

6. The device of claim 5 wherein the engaging means comprises a plurality of separators disposed in spaced relationship with the cavity, each of the separators to be received within each of a respective first or second slot.

7. The device of claim 1, and further comprising first and second numerals on each of the support members associated with a respective first and second end, each numeral representing the height that the platform with a respective first or second end being received within the cavity is being maintained above a surface and means on the walls for viewing the numbers.

8. The device of claim 7, wherein the numeral is located at or near each first and second end and wherein the numerals are in diametrically opposed relationship with each other and said viewing means comprises an opening in each of the walls which is in registry with each numeral when the support member is received within a cavity.

9. The device of claim 5, wherein each of the support members comprises a plurality of equally dimensioned units which are integrally joined together at a juncture to form the first and second slots.

10. A device for aerobic step exercises, comprising:

(a) a platform having a flat top and a flat bottom surface and defining a cavity through its bottom surface;

(b) a support member having opposed first and second ends that are selectively received within the cavity, the first end defining a first opening therein of a first depth and the second end defining a second opening therein of a second depth; and (c) means within the cavity for engaging the first and second openings.

11. The device of claim 10 and further comprising a first numeral on the support member adjacent the first end and a second numeral on the support member adjacent the second end and means on the platform for viewing the numeral when a respective end is within the cavity, each numeral indicating a height at which the top is being maintained above a support surface by the support member.

12. The device of claim 10 wherein the platform defines two cavities through its bottom surface in opposed relationship to each other and wherein there is a support member for each cavity.

13. A device for aerobic step exercising, comprising (a) a platform having a flat top;

(b) a pair of end walls downwardly depending from opposed edges of the platform;

(c) rectangular cavities formed in the underside of the platform, adjacent to the end walls;

(d) a pair of equally dimensioned support members that each have opposed first and second ends which are dimensioned to be received within the cavities, the first and second ends defining a first and second opening therein, respectively, with the openings being in vertical alignment with each other and having a first and second depth, respectively;

(e) means in each cavity for engaging the openings when each of a selected first or second end of the support members is inserted into a cavity, so that the platform is maintained at certain selected heights above a support surface depending upon which of the first and second ends are within the cavities; and (f) first and second numerals on each of the support members associated with a respective first and second end, each numeral representing the height that the platform, with a respective first or second end being received within the cavity, is being maintained above a surface and means on the walls for viewing the numbers.

14. The device of claim 13, wherein the numeral is located at or near each first and second end and wherein the numerals are in diametrically opposed relationship with each other and said viewing means comprises an opening in each of the walls which is in registry with each numeral when the support member is received within a cavity.

15. A device for aerobic step exercises, comprising:

(a) a platform having a flat top and a flat bottom surface and defining a cavity through its bottom surface;

(b) a support member having opposed first and second ends that are selectively received within the cavity, the first end defining a first opening therein of a first depth and the second end defining a second opening therein of a second depth;

(c) means within the cavity for engaging the first and second openings; and (d) a first numeral on the support member adjacent the first end and a second numeral on the support member adjacent the second end and means on the platform for viewing the numeral when a respective end is within the cavity, each numeral indicating a height at which the top is being maintained above a support surface by the support member.

* * * * *